US008656621B2

(12) United States Patent
Chvala

(10) Patent No.: US 8,656,621 B2
(45) Date of Patent: Feb. 25, 2014

(54) HEATSHIELD ACCESSORY FOR FIREARMS

(75) Inventor: John R. Chvala, Grafton, WI (US)

(73) Assignee: Advanced Technology International USA, LLC, Cedarburg, WI (US)

( * ) Notice: Subject to any disclaimer, the term of this patent is extended or adjusted under 35 U.S.C. 154(b) by 38 days.

(21) Appl. No.: 13/449,690

(22) Filed: Apr. 18, 2012

(65) Prior Publication Data

US 2013/0276342 A1 Oct. 24, 2013

(51) Int. Cl.
*F41C 23/16* (2006.01)

(52) U.S. Cl.
CPC ..... *F41C 23/16* (2013.01)
USPC ..... 42/71.01; 42/90; 89/14.1

(58) Field of Classification Search
CPC ..... F41C 7/04; F41C 7/02; F41C 23/16; F41A 99/00; F41A 35/00; F41A 21/44
USPC ..... 42/71.01, 71.02, 85, 90, 94; 89/14.1, 89/14.05
See application file for complete search history.

(56) References Cited

U.S. PATENT DOCUMENTS 4,346,643 A * 8/1982 Taylor et al. ..... 89/14.1
4,601,123 A * 7/1986 Swearengen et al. ..... 42/72
4,663,875 A * 5/1987 Tatro ..... 42/71.01
7,882,654 B1 * 2/2011 Marcum et al. ..... 42/90
2009/0044439 A1 * 2/2009 Phillips et al. ..... 42/72
2012/0317859 A1 * 12/2012 Brown ..... 42/71.01

OTHER PUBLICATIONS

ATI Heat Shield, www.web.archive.org/web/20100503171058/http://shotgun500tactical.com/ATI-Heat-Shield-For-tactical-shotgun-p/; May 3, 2010.*

* cited by examiner

*Primary Examiner* — Stephen M Johnson
*Assistant Examiner* — Joshua Freeman
(74) *Attorney, Agent, or Firm* — Andrus Intellectual Property Law, LLP

(57) ABSTRACT

A heatshield assembly for a metal barrel of a firearm includes a heatshield body provided with a rear end extending to a front end, and configured to overlie the barrel of the firearm. An insulating mounting arrangement is frictionally attached to and located within the heatshield body. The mounting arrangement is separate from the heatshield body for mounting the heatshield body to the barrel of a firearm in a continuous spaced relationship therefrom without damaging the barrel. With the heatshield body constructed of a metal material, the mounting arrangement is particularly constructed to prevent metal-to-metal contact between the heatshield body and the barrel.

23 Claims, 6 Drawing Sheets

HEATSHIELD ACCESSORY FOR FIREARMS

BACKGROUND OF THE INVENTION

The present disclosure relates generally to firearm accessories, and more particularly, pertains to a heatshield assembly provided for a barrel of a firearm or weapon.

It is well known to those skilled in the art that rapid fire weapons, such as semi-automatic or automatic rifles and shotguns, are characterized by the heating of their metal barrels to relatively high temperatures, often in excess of 600° F. At such intense temperatures, the barrels cannot be comfortably or safely handled by the shooter of the weapon. Various expedients, typically in the form of heatshield assemblies, have been resorted to in the past in an attempt to protect the hands of the person firing the weapon from harmful contact with the excessively hot barrel.

Certain known heatshield assemblies typically include a curved, perforated metallic body having front and rear tabs, clamps, flanges or other retaining structures which are integrally formed on the body. These integral retaining structures are bent, clamped and secured with additional fasteners to the metal barrel to mount the heatshield assembly along substantially the entire length of the barrel. Such known heatshield assemblies have been designed to allow dissipation of heat to protect the shooter's hands during the rapid discharging of the firearm. Unfortunately, installation and use of these currently available heatshield assemblies results in sliding metal-to-metal contact between the heatshield body and the barrel causing possible damage to the barrel which is undesirable.

Accordingly, there is a need to provide a heatshield assembly in which a heatshield body is secured to the barrel of a firearm in a suspended, isolated relationship so as to prevent any direct metal-to-metal contact between the heatshield body and the barrel, and eliminate any scratching or damage to the barrel. There is an additional need to provide a firearm heatshield assembly having a mounting arrangement which can prevent movement of the heatshield body on the barrel during use, withstand temperatures in excess of 600° F., and enable optional attachment of further accessories to the heatshield body.

SUMMARY OF THE INVENTION

The present disclosure relates to a firearm heatshield assembly including a heatshield body having a pair of opposed ends, the heatshield body being adapted to overlie a barrel of the firearm. The heatshield assembly includes an insulating mounting arrangement frictionally attached and located within the heatshield body. The mounting arrangement is adapted to mount the heatshield body to the barrel of the firearm in continuous spaced relationship therefrom.

The heatshield body is provided with retaining structure for the mounting arrangement, and the mounting arrangement is snap fit into the retaining structure. The heatshield body is provided with a set of mounting holes, and the mounting arrangement includes a first mounting arrangement located at one end of the heatshield body, and a second mounting arrangement located at the other end of the heatshield body. The first mounting arrangement is snap fit into walls defining certain of the mounting holes, and the second mounting arrangement is snap fit into walls defining other of the mounting holes. The mounting arrangement includes a clipping structure which is snap fit within the heatshield body at one location, and a clamping structure which is snap fit within the heatshield body at another location. In a preferred embodiment, the heatshield body is formed of a metal material, and the mounting arrangement includes a plurality of non-metal mounting elements.

The heatshield body is configured of an elongated, perforated and inverted shell having an arcuate upper wall and a pair of opposed sidewalls depending from the upper wall. The heatshield body has a tapered construction with one end of the heatshield body having an inverted substantially semi-cylindrical configuration, and the opposite end of the heatshield body having an inverted substantially U-shaped configuration. One end of the heatshield body is provided with a first set of mounting holes located on the opposed sidewalls of the heatshield body, and the other end of the heatshield body is provided with a second set of mounting holes located on the opposed sidewalls and the upper wall of the heatshield body.

The mounting arrangement includes a resilient arcuate clip having an inner surface provided with a first silicon pad structure, and an outer surface provided with nibs that are snap fit into walls defining the first set of mounting holes. Lower portions of the clip are provided with wings which are snap fit into engagement with lower edges on the opposed sidewalls of the heatshield body. The mounting arrangement also includes a pair of spacer blocks lying along inside surfaces of the opposed sidewalls of the heatshield body, and having projections which are snap fit into walls defining the second set of mounting holes located on the opposed sidewalls of the heatshield body, the spacer blocks having angled mounting surfaces for mounting a second silicon pad structure thereon. The mounting arrangement further includes a third silicon pad structure having a tab which is snap fit into a wall defining one of the second set of mounting holes on the upper wall of the heatshield body. The mounting arrangement additionally includes a pair of rail attachments positioned on external surfaces of the opposed sidewalls of the heatshield body and aligned with the spacer blocks, and a pair of fasteners. Each fastener is passed through one of the rail attachments, one of the opposed sidewalls, both spacer blocks and the other of the opposed sidewalls, and threaded into the other of the rail attachments.

The present disclosure also relates to a heatshield assembly for a metal barrel of a firearm including a heatshield body provided with a rear end extending to a front end, and configured to overlie the barrel of the firearm. An insulating mounting arrangement is frictionally attached to and located within the heatshield body. The mounting arrangement is separate from the heatshield body for mounting the heatshield body to the barrel of the firearm in continuous spaced relationship therefrom without damaging the barrel.

The heatshield body is constructed of a metal material, and the mounting arrangement is constructed to prevent metal-to-metal contact between the heatshield body and the barrel. The heatshield body is provided with retaining structure for the mounting arrangement, and the mounting arrangement includes a clipping structure snap fit into the retaining structure inside a rear end of the heatshield body, and a clamping structure snap fit into the retaining structure inside the front end of the heatshield body. The mounting arrangement also includes a silicon pad structure which is engageable with the barrel to protect an external finish thereof.

The present disclosure also contemplates a method of mounting a heatshield assembly to a metal barrel of a firearm. The method includes the steps of a) providing a heatshield assembly having a rear end, a front end, an arcuate upper wall, and a pair of opposed sidewalls pending from the upper wall; b) providing a rear mounting arrangement which is snap fit within the rear end of the heatshield body; c) providing a front mounting arrangement which is snap fit within the front end of the heatshield body; d) snapping the rear mounting arrangement onto a rear portion of the barrel; and e) clamping the front mounting arrangement on a front portion of the barrel. With this method of assembly, the front mounting arrangement and the rear mounting arrangement mount the heatshield body to the barrel in continuous spaced relationship therefrom without damaging the barrel.

The rear mounting arrangement includes a non-metal resilient clip having an inner surface provided with a first silicon pad structure engageable with the barrel, and an outer surface provided with nibs that are snap fit into walls defining rear mounting holes on the rear end of the heatshield body. The front mounting arrangement includes a pair of non-metal spacer blocks provided with projections that are snap fit into walls defining front mounting holes at the front end of the heatshield body, the spacer blocks being provided with a second silicon pad structure engageable with the lower portion of the barrel. The front mounting arrangement further includes a third silicon pad structure snap fit by means of a tab into a mounting hole formed in the upper wall of the heatshield body at the front end thereof, and engageable with an upper portion of the barrel. The front mounting arrangement also includes a pair of rail attachments positioned on external surfaces of the opposed sidewalls at the front end of the heatshield body. A pair of fasteners enable the clamping of the front mounting arrangement. Each fastener is passed through one of the rail attachments, one of the sidewalls, the pair of spacer blocks and the other of the opposed sidewalls, and threaded into the other of the rail attachments.

BRIEF DESCRIPTION OF THE DRAWINGS

The drawings illustrate the best mode presently contemplated in carrying out the disclosure. In the drawings.

DETAILED DESCRIPTION OF THE INVENTION

Figure 1:
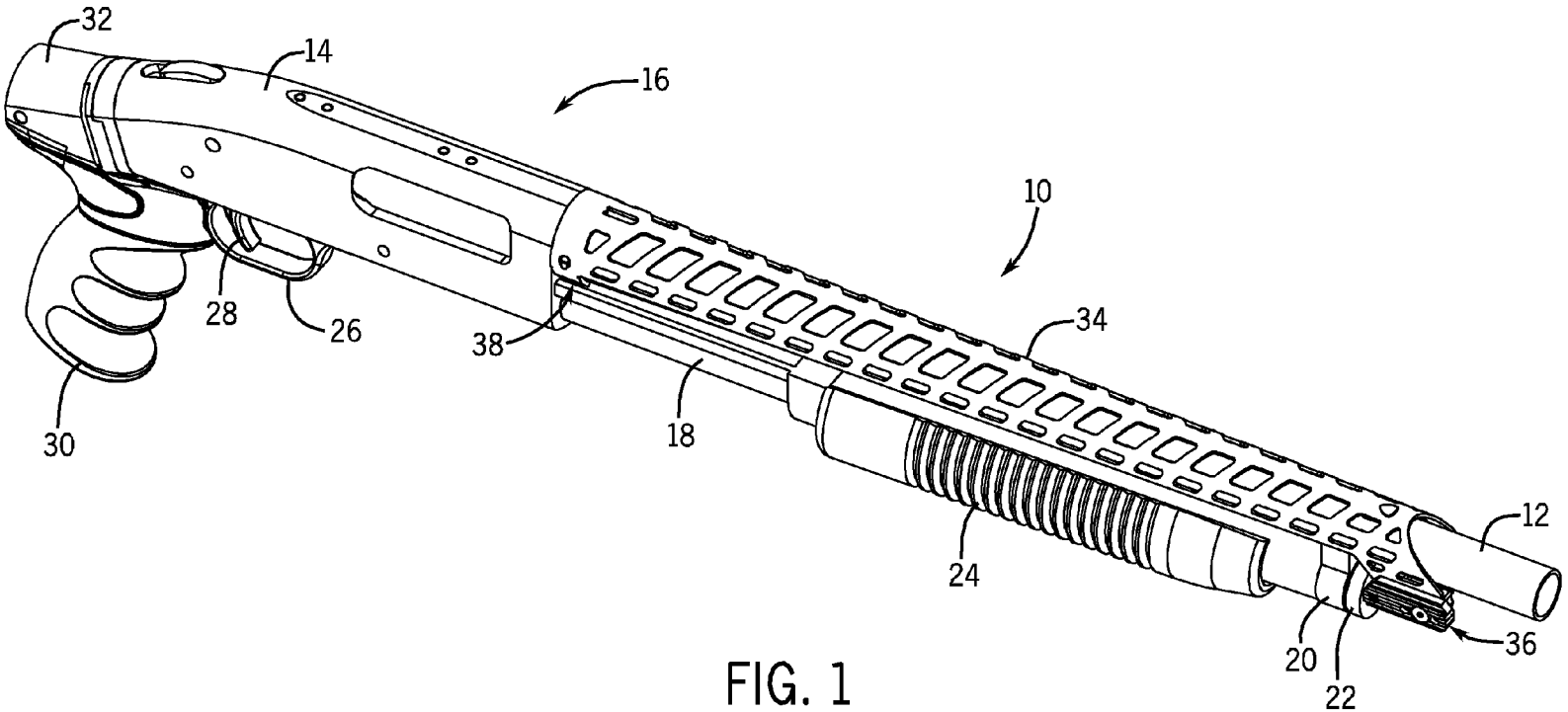
FIG. 1 is a top perspective view of a shotgun having a barrel provided with a heatshield assembly in accordance with the present disclosure.
Figure 2:
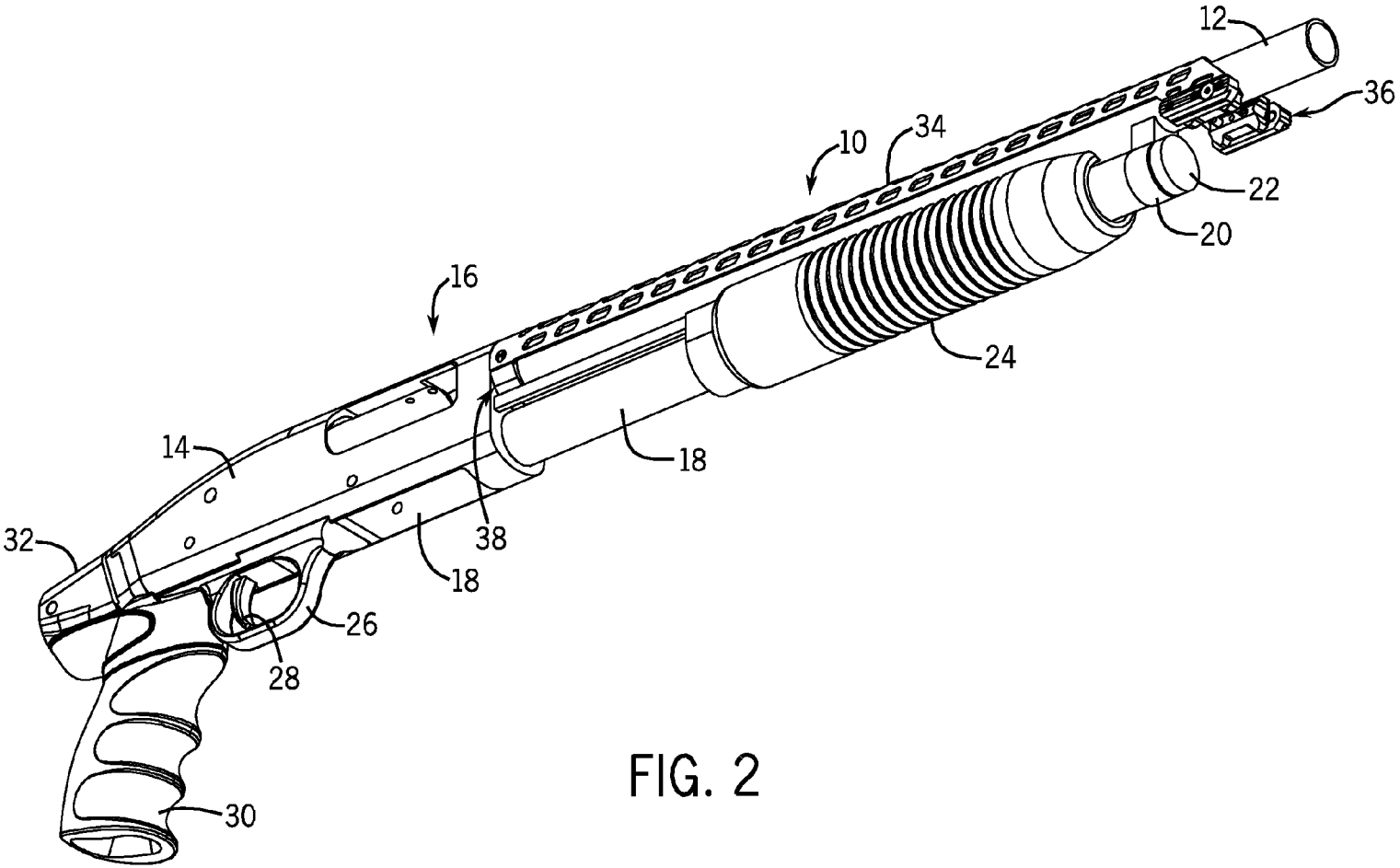
FIG. 2 is a bottom perspective view of FIG. 1.

Referring now to the drawings, FIGS. 1 and 2 illustrate a heatshield assembly 10 mounted on a metal barrel 12 extending forwardly from a receiver 14 of a firearm, such as a shotgun 16.

Shotgun 16 typically includes a cartridge-storing magazine tube 18 that extends longitudinally from the receiver 14 and below the barrel 12. A forward portion of the magazine tube 18 engages a barrel lug 20 and is held thereto by a magazine cap 22. A gripping forend 24 is slidably mounted for back and forth or "pumping" movement relative to the magazine tube 18. Shotgun 16 also includes a trigger guard 26, a trigger 28 and a pistol grip 30 connected via a mounting device 32 below and at a rear end of the receiver 14.

In accordance with the present disclosure, the heatshield assembly 10 is comprised of a heatshield body 34 and an insulating mounting arrangement, specifically a front mounting arrangement 36 and a rear mounting arrangement 38, separate from and frictionally retained with the heatshield body 34, for fixedly mounting the heatshield body 34 to the barrel 12 so that the heatshield body 34 is continuously maintained separated or isolated therefrom. In addition, the mounting arrangement 36, 38 provides for clipping and clamping the heatshield body 34 to the barrel 12 in a manner which will not scratch or damage the barrel 12.

Figure 3:
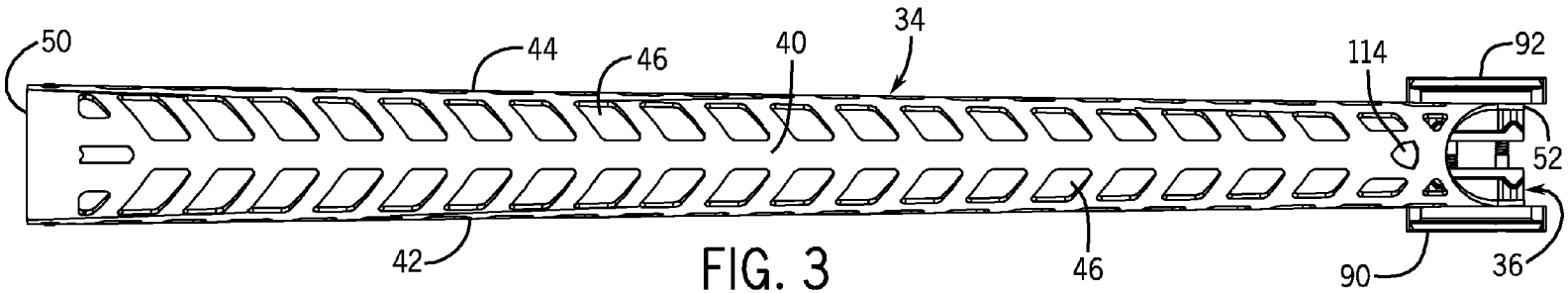
FIG. 3 is a top view of the heatshield assembly of FIGS. 1 and 2 removed from the shotgun.
Figure 4:
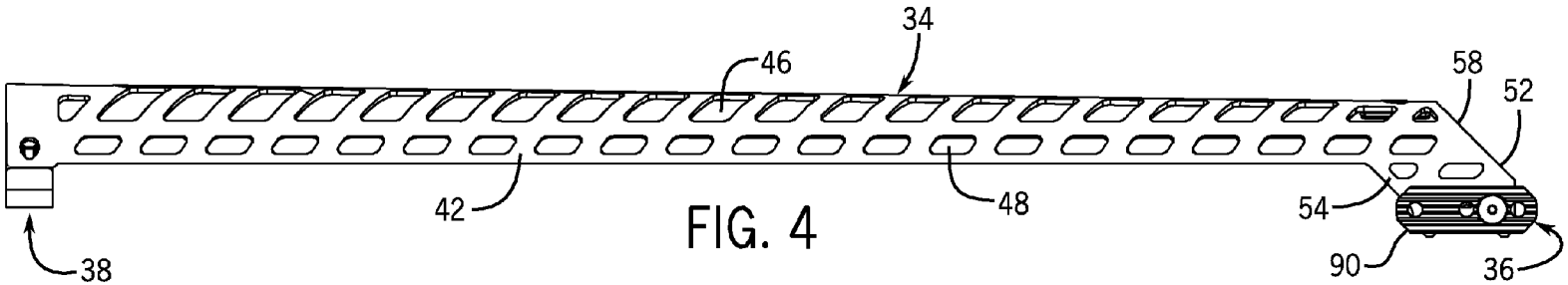
FIG. 4 is an elevational view of the heatshield assembly shown in FIGS. 1 and 2.
Figure 5:
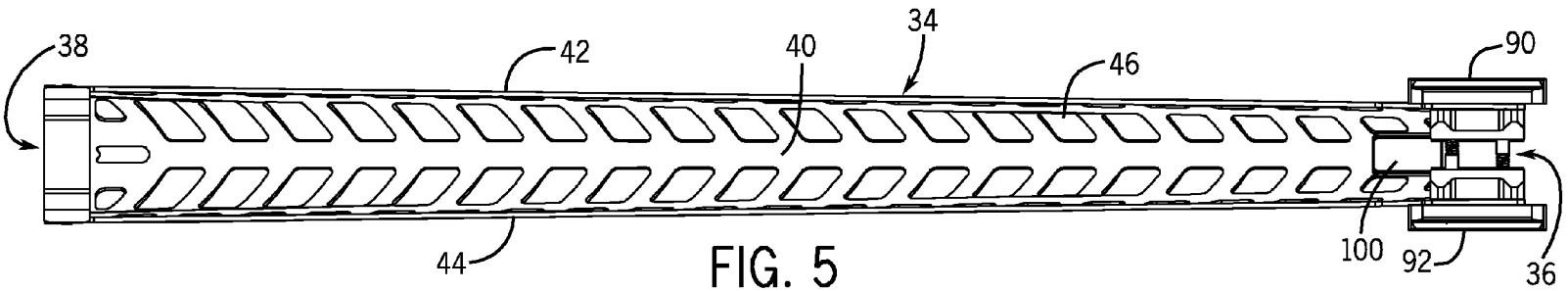
FIG. 5 is a bottom view of the heatshield assembly shown in FIGS. 1 and 2.
Figure 6:
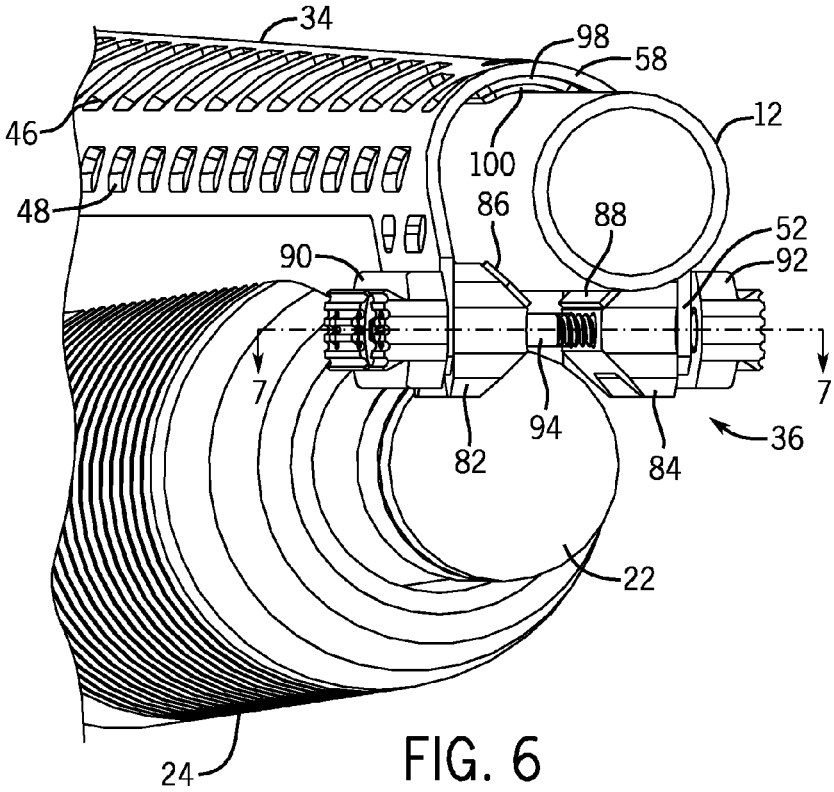
FIG. 6 is an enlarged, fragmentary perspective view of a front end of the heatshield assembly mounted on the barrel of the shotgun.
Figure 8:
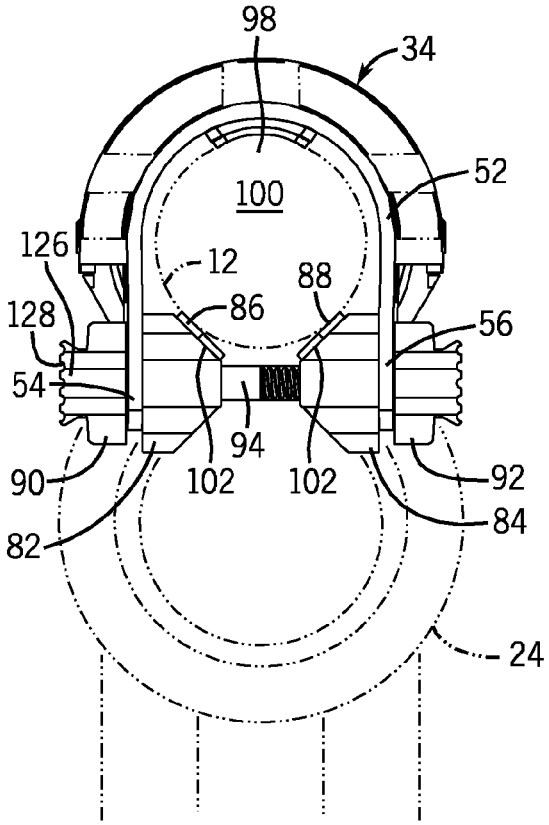
FIG. 8 is a front view of FIG. 6 showing elements of the shotgun in phantom lines.

Referring now to FIGS. 3-5, the heatshield body 34 is constructed as an elongated, perforated and inverted shell which is preferably comprised of a powder coated, high strength steel or other suitable metal material. As will be further explained hereafter, the heatshield body 34 is sized and shaped to be suspended over an upper portion of the barrel 12, and secured thereto at front and rear ends. The heatshield body 34 is integrally formed with an arcuate upper wall 40 and a pair of opposed sidewalls 42, 44 depending from the upper wall 40. The walls 40, 42, 44 are formed with a series of vent holes 46 and vent slots 48 along the length of the heatshield body 34 to permit air flow therethrough. The heatshield body 34 tapers from a rear end 50 having an inverted semi-cylindrical configuration (FIG. 9) to a front end 52 having an inverted U-shaped configuration (FIG. 8). The tapering of heatshield body 34 typically corresponds to the tapering of barrel 12 which has a larger diameter at a rearward end and a smaller diameter at a forward end. As seen best in FIGS. 4 and 10, the front end 52 includes opposed side portions 54, 56 that extend downwardly and forwardly on the heatshield body 34, and a cutaway portion 58 which extends upwardly and rearwardly of the heatshield body 34.

Figure 10:
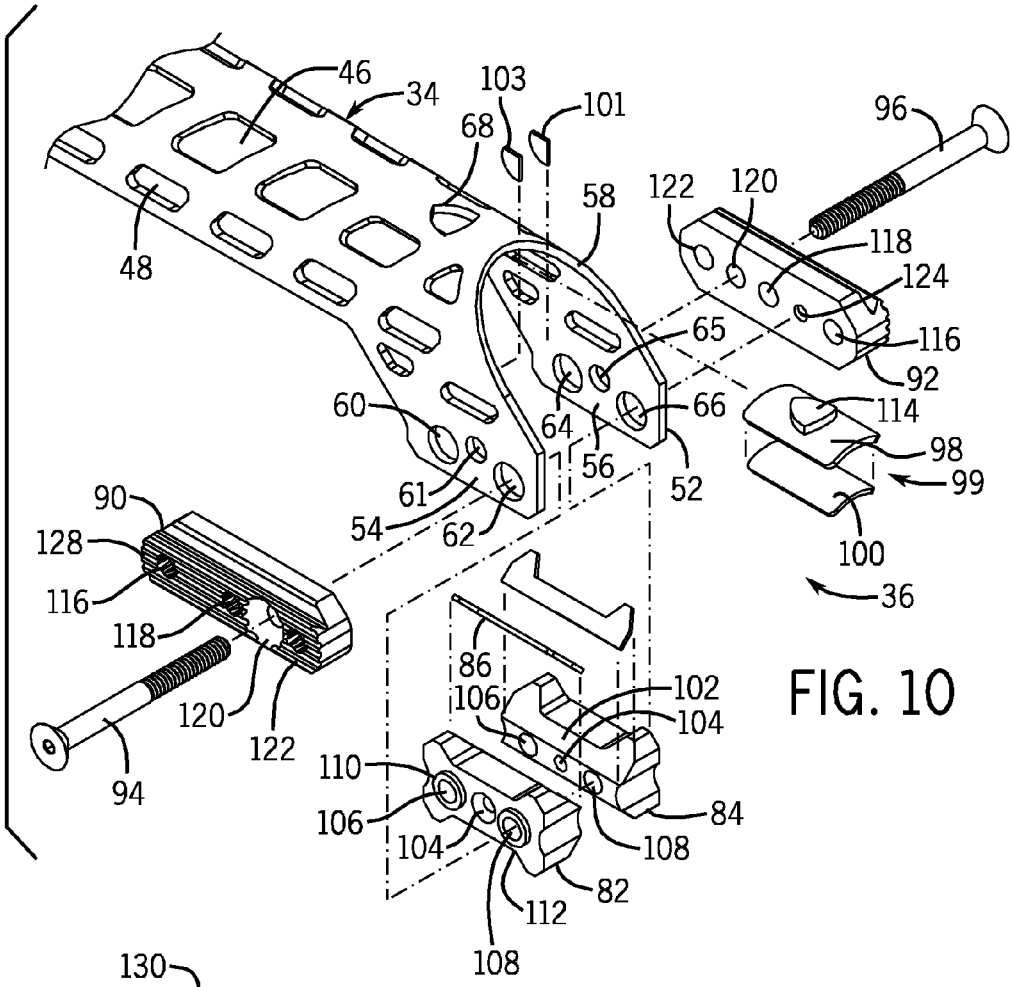
FIG. 10 is an exploded view of a front end of the heatshield assembly.
Figure 11:
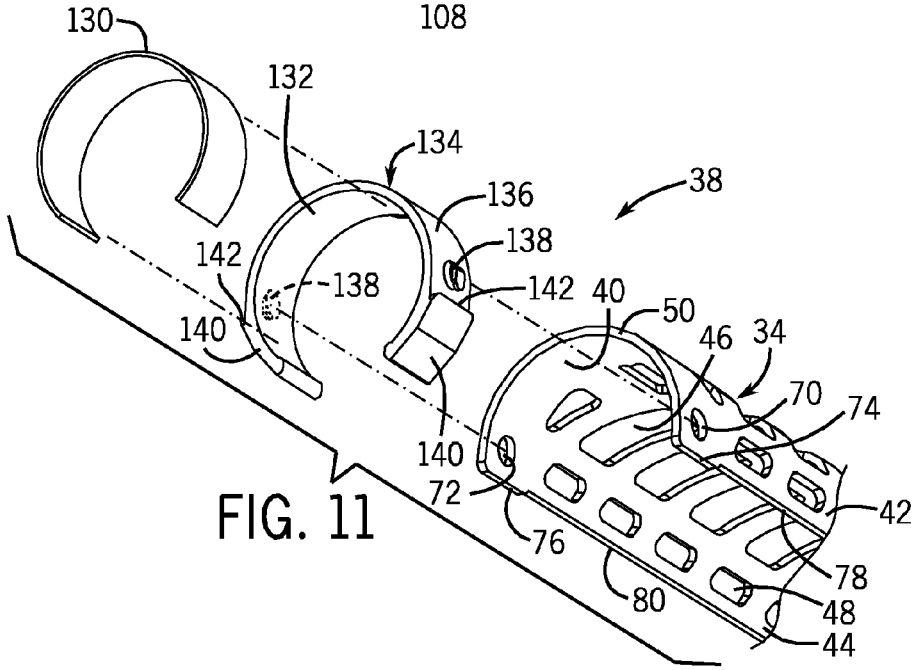
FIG. 11 is an exploded view of a rear end of the heatshield assembly.

The heatshield body 34 is formed with various retaining structure for receiving and retaining the front and rear mounting arrangements 36, 38. As also seen in FIG. 10, the front end side portion 54 is provided with a set of mounting holes 60, 61, 62 which are aligned with a set of mounting holes 64, 65, 66 on the opposite front end side portion 56. In addition, the arcuate upper wall 40 adjacent front end 52 is provided with a three-sided mounting hole 68. Turning to FIG. 11, the sidewalls 42, 44 adjacent rear end 50 are formed with aligned respective mounting holes 70, 72, and extensions 74, 76 that project slightly below respective bottom edges 78, 80 of the sidewalls 42, 44.

With further reference to FIG. 10, front mounting arrangements 36 includes a pair of spacer blocks 82, 84 provided with respective high temperature resistant silicon pads 86, 88. The front mounting arrangement 36 further includes a pair of side rail arrangements 90, 92, threaded fasteners 94, 96, and a silicon pad structure 99 including a high temperature resistant silicon pad 100 supported by a glass filled nylon polymer support member 98. A pair of silicon pads 101 and 103 are attached to the inner surface of the heatshield body 34 near the mounting holes 60, 64 respectively. In the exemplary embodiment shown, the spacer blocks 82, 84 are constructed from a non-metal material, such as an extreme temperature resistant polymer (e.g. glass filled nylon), and the rail attachments 90, 92 are typically constructed of aluminum.

Figure 7:
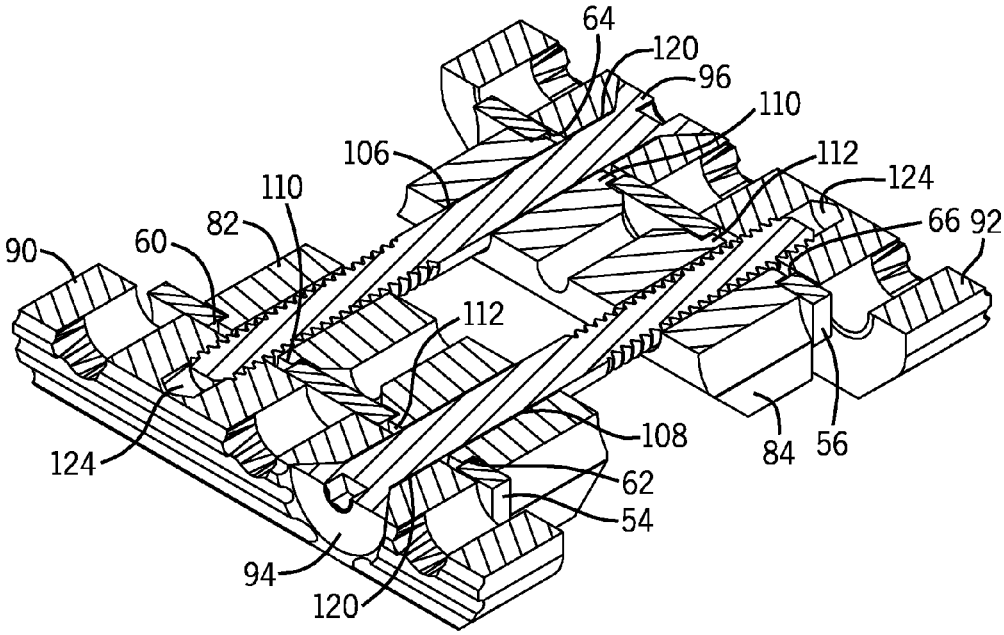
FIG. 7 is a sectional view taken on line 7-7 of FIG. 6.

Spacer blocks 82, 84 are identical, and are constructed with angled mounting faces 102 for retaining the silicon pads 86, 88 (FIG. 8) such as with an adhesive applied to the bottom surfaces thereof. Spacer blocks 82, 84 are each provided with a center throughhole 104 and a pair of outer throughholes 106, 108 on opposite sides of center throughhole 104. Outer faces of the spacer block 82, 84 are formed with circular projections 110, 112 surrounding throughholes 106, 108, and the outer faces are designed to be positioned against inner surfaces of the front and side portions 54, 56. With the spacer blocks 82, 84 so positioned, the projections 110, 112 are aligned with, snap fit and frictionally retained within walls forming the mounting holes 60, 62, 64, 66, as best seen in FIG. 7.

Silicon pad 100 (FIG. 10) is slightly curved so as to be correspondingly positioned against the lower surface of arcuate upper wall 40. The silicon pad 100 is connected to the support member 98 by any suitable means. A tab 114 is provided on an upper surface of the support member 98, and is sized and shaped so that it is snapped into and frictionally retained in the wall forming mounting hole 68 of the heatshield body 34 so that the silicon pad structure 99 including the support member 98 and the silicon pad 100 together is mounted as shown in FIG. 8.

Rail attachments 90, 92 (FIG. 10) are identically formed with a series of threaded throughholes 116, 118 and 122 and an unthreaded hole 120. Threaded blind holes 124 (FIG. 7) which open into rail attachment inner surfaces designed to be positioned against outer surfaces of the side portions 54, 56. As will be understood below, the rail attachments 90, 92 serve as nuts in clamping the heatshield body 34 to the front of the barrel 12, and also function as mounting surfaces for optional firearm accessories that may be attached to the front of the shotgun 16. For this latter function the rail attachments 90, 92 include outer mounting surfaces 126, each having a dovetail construction with a ribbed external surface 128 as seen best in FIGS. 8 and 9.

As shown in FIG. 11, the rear mounting arrangement 38 includes a high temperature resistant silicon pad 130 which is positioned and retained by any suitable means on an inside surface 132 of an arcuate resilient clip 134. The clip 134 is preferably constructed of a non-metal material, such as an extreme temperature resistant polymer (e.g. glass filled nylon), and is sized and shaped to be received and frictionally retained in a snap fit upon a rear end of the barrel 12 as well as within the heatshield body 34 adjacent the rear end thereof. To facilitate the retention of the clip 134 within the heatshield body 34, an outer surface 136 of the clip 134 is provided with a pair of laterally extending nibs 138 and a pair of wings 140 beneath the nibs 138. The nibs 138 are designed to be frictionally retained in a snap fit within the walls defining the mounting hole 70, 72 adjacent the rear ends 50 of heatshield body 34. The wings 140 are configured with ledges 142 (FIG. 9) to be frictionally engaged in a snap fit with the extensions 74, 76 located beneath the mounting holes 70, 72.

Figure 9:
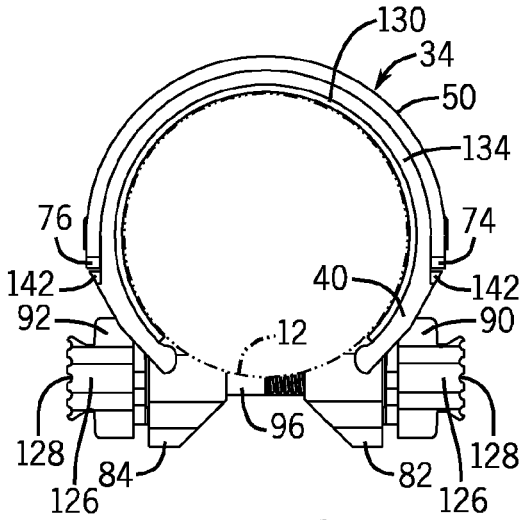
FIG. 9 is a rear view of the heatshield assembly of FIG. 6 with certain elements of the shotgun removed.

When it is desired to install the heatshield body 34 upon the barrel 12, the resilient clip 134 is snapped onto a rear portion of the barrel 12 so that silicon pad 130 engages the periphery of barrel 12. The rear end 50 of the heatshield body 34 is frictionally attached on the external surface of the clip 134 attached to barrel 12 such that the nibs 138 snap into the walls forming mounting holes 70, 72 and the ledges 142 of wings 140 snap into engagement with the extensions 74, 76 as seen in FIG. 9. At the front end 52 of the heatshield body 34, the spacer blocks 82, 84 with pads 86, 88 are snapped into the walls forming the mounting holes 60, 62, 64, 66 from the inside surfaces of side portions 54, 56, and the connected support member 98 and silicon pad 100 is snapped via tab 114 into the wall forming the hole 68 from the inner surface of the upper wall 40 of the heatshield body 34. The silicon pads 86, 88 are engaged with lower portions of the barrel 12, and the silicon pad 100 is engaged with an upper end of the barrel 12 as seen in FIG. 8. The silicon pads 86, 88, 100 and 130 serve an important function in protecting the external finish of the barrel 12.

The inner surfaces of rail attachments 90, 92 are placed against external surfaces of the side portions 54, 56, respectively. Specifically, the inner surface of rail attachment 90 is disposed against the external surface of side portion 54 so that the throughhole 120 is aligned with mounting hole 62, aligned throughholes 108 of spacer blocks 82, 84, mounting hole 66 on the side portion 56, and blind hole 124 on rail attachment 92. The inner surface of rail attachment 92 is positioned against the external surface of the side portion 56 so that the throughhole 120 is aligned with mounting hole 64, the throughholes 106 of spacer blocks 82, 84, and mounting hole 60 on side portion 54 and blind hole 124 on rail attachment 90. Fastener 94 is passed through aligned throughhole 120 of rail attachment 90, mounting hole 62 on side portion 54, throughholes 108 of spacer blocks 82, 84 and mounting hole 66 on side portion 56, and is threaded into blind hole 124 on rail attachment 92 as seen in FIG. 7. Fastener 96 is passed through aligned throughhole 120 of rail attachment 92, mounting hole 64 on side portion 56, the throughholes 106 of spacer blocks 82, 84 and mounting hole 60 on side portion 54, and is threaded into blind hole 124 on rail attachment 90. The fasteners 94, 96 are then tightened appropriately to clamp and secure the front end of the heatshield body 34 to the barrel 12. The heads of fasteners 94, 96 when fully threaded in rail attachments 90, 92 lie recessed in countersunk areas leading to throughholes 120 so that the heads do not protrude from the ribbed surfaces 128 of the rail attachments 90, 92. In assembled position, the rear end 50 of the heatshield body 34 abuts a front end of receiver 14, and the front end of heatshield body 34 lies slightly behind the muzzle end of barrel 12. If desired, Picatanny rails can be further added to the outer mounting surfaces 126 of rail attachments 90, 92 by means of a dovetail fit so as to further supplement the shotgun 16 with other firearm accessories such as sights, flashlights, laser devices, shotgun shell holders and the like.

It should be appreciated that the present disclosure provides a unique heatshield assembly 10 for a firearm 16 wherein a heatshield body 34 is mounted to a barrel 12 by an insulating mounting arrangement 36, 38 which maintains the heatshield body 34 isolated, suspended and in free floating relationship relative to the barrel 12 along the entire length of the heatshield body 34. The mounting arrangement 36, 38 features snap fit elements on a clip 134 at a rear end of the heatshield body 34, and spacer blocks 82, 84 at a front end 52 of the heatshield body 34. The clip 134 and the clamping spacer blocks 82, 84 together with silicon pads 86, 88, 100, 101, 103 and 130 secure the heatshield body 34 to the barrel 12 to prevent sliding movement of the heatshield body 34 during both installation and use of the shotgun 16. The silicon pads 86, 88, 100, 101, 103 and 130 can withstand temperatures in excess of 600° F. and, together with the spacer blocks 82, 84 and clip 134, prevent metal-to-metal contact between the heatshield body 34 and the barrel 12, and eliminates scratching or other damage to the barrel 12. The silicon pads 86, 88, 100, 101, 103 and 130, the polymeric spacer blocks 82, 84 and the clip 134 act as thermal insulators to prevent direct transfer of heat from the barrel 12 to the heatshield body 34 so that heat is dissipated through the vent holes 46 and slots 48 thereof. The heatshield assembly 10 permits the attachment of optional firearm accessories at the front end 52 using the rail attachments 90, 92, if desired.

It should be understood that the heatshield assembly 10 can be conveniently provided as a kit comprised of the heatshield body 34, the spacer blocks 82, 84, the rail attachments 90, 92, the fasteners 94, 96, the clip 134 and the silicon pads 86, 88, 100, 130.

Various alternatives are contemplated as being within the scope of the following claims particularly pointing out and distinctly claiming the subject matter regarded as the invention.

What is claimed is:

1. A firearm heatshield assembly comprising: a heatshield body having a pair of opposed ends provided on an arcuate shell having an inner surface, an outer surface and a pair of bottom edges, the heatshield body being adapted to overlie a barrel of a firearm subject to generating heat during firing thereof; and an insulating mounting arrangement frictionally attached to and positioned at different locations within the heatshield body, the insulating mounting arrangement including a clipping structure which is snap fit within the heatshield body at one location, and a clamping structure which is snap fit within the heatshield body at another location, wherein the clipping structure is engaged with the inner surface and the bottom edges of the heatshield body, and the clamping structure is engaged with the inner surface and the outer surface of the heatshield body, the insulating mounting arrangement being adapted to mount the heatshield body to the barrel of the firearm in a continuous spaced relationship therefrom, wherein the insulating mounting arrangement includes thermal insulating elements at different locations configured to prevent heat transfer through the thermal insulating elements to the heatshield body.

2. The heatshield assembly of claim 1, wherein the heatshield body is provided with a retaining structure for the insulating mounting arrangement, and the mounting arrangement is snap fit into the retaining structure.

3. The heatshield assembly of claim 1, wherein the heatshield body is provided with a set of mounting holes, and the insulating mounting arrangement includes a first insulating mounting arrangement located at one end of the heatshield body, and a second insulating mounting arrangement located at the other end of the heatshield body, the first insulating mounting arrangement being snap fit into walls defining certain of the mounting holes, and the second insulating mounting arrangement being snap fit into walls defining other of the mounting holes.

4. The heatshield assembly of claim 1, wherein the heatshield body is formed of a metal material, and the insulating mounting arrangement includes a plurality of non-metal mounting elements.

5. The heatshield assembly of claim 1, wherein the shell of the heatshield body is configured as an elongated, perforated and inverted surface having an arcuate upper wall and a pair of opposed sidewalls depending from the upper wall.

6. The heatshield assembly of claim 1, wherein the heatshield body has a tapered construction with one end of the heatshield body having an inverted, substantially semi-cylindrical configuration, and the opposite end of the heatshield body having an inverted substantially U-shaped configuration.

7. The heatshield body of claim 1, wherein one end of the heatshield body is provided with a first set of mounting holes located on opposed sidewalls of the heatshield body, and the other end of the heatshield body is provided with a second set of mounting holes located on the opposed sidewalls and on an upper end of the heatshield body.

8. The heatshield assembly of claim 7, wherein the insulating mounting arrangement includes a resilient, arcuate clip having an inner surface provided with a first silicon pad structure, and an outer surface provided with nibs which are snap fit into walls defining the first set of mounting holes.

9. The heatshield assembly of claim 8, wherein lower portions of the clip are provided with wings which are snap fit into engagement with lower edges on the opposed sidewalls of the heatshield body.

10. The heatshield assembly of claim 9, wherein the insulating mounting arrangement includes a pair of spacer blocks lying along inside surfaces of the opposed sidewalls of the heatshield body, and having projections which are snap fit into walls defining the second set of mounting holes located on the opposed sidewalls of the heatshield body, the spacer blocks having angled mounting surfaces for mounting a second silicon pad structure thereon.

11. The heatshield assembly of claim 10, wherein the insulating mounting arrangement includes a third silicon pad structure having a tab which is snap fit into a wall defining one of the second set of mounting holes on the upper end of the heatshield body.

12. The heatshield assembly of claim 10, wherein the insulating mounting arrangement includes a pair of rail attachments positioned on external surfaces of the opposed sidewalls of the heatshield body and aligned with the spacer blocks, and a pair of fasteners, each fastener being passed through one of the rail attachments, one of the opposed sidewalls, the pair of spacer blocks and the other of the opposed sidewalls, and threaded into the other of the rail attachments.

13. A heatshield assembly for a metal barrel of a firearm comprising:

A heatshield body with vent openings provided with a rear end extending to a front end, and configured to overlie the barrel of the firearm subject to generating heat during firing thereof; and An insulating mounting arrangement frictionally attached to and positioned at different locations within the heatshield body, the insulating mounting arrangement being separate from the heatshield body for mounting the heatshield body to the barrel of the firearm in a continuous spaced relationship therefrom along the entire length of the heatshield body without damaging the barrel, the heatshield body provided with a retaining structure for the insulating mounting arrangement, the insulating mounting arrangement including a clipping structure snap fit into the retaining structure inside the rear end of a heatshield body, and a clamping structure snap fit into the retaining structure inside the front end of the heatshield body, wherein the insulating mounting arrangement includes a silicon pad structure which is engageable with the barrel to protect an external finish thereof.

14. The heatshield assembly of claim 13, wherein the heatshield body is constructed of a metal material, and the insulating mounting arrangement is constructed to prevent metal-to-metal contact between the heatshield body and the barrel.

15. The heatshield assembly of claim 13, wherein the insulating mounting arrangement includes thermal insulating elements at the different locations configured to prevent heat transfer from the barrel through the thermal insulating elements to the heatshield body so that heat is released through the vent openings of the heatshield body.

16. A method of mounting a heatshield assembly to a metal barrel of a firearm subject to generating heat during firing thereof, the method comprising the steps of:

a) providing a heatshield body having a rear end, a front wall, an arcuate upper wall and a pair of opposed sidewalls depending from the upper wall;

b) providing a rear mounting arrangement which is snap fit snap fit within the rear end of the heatshield body, the rear mounting arrangement including a clipping structure engaged with an inner surface and bottom edges of the heatshield body;

c) providing a front mounting arrangement which is snap fit within the front end of the heatshield body, the front mounting arrangement including a clamping structure engaged with the inner surface and an outer surface of the heatshield body;

d) snapping the rear mounting arrangement onto a rear portion of the barrel; and e) clamping the front mounting arrangement on a front portion of the barrel, wherein in the front mounting arrangement and the rear mounting arrangement mount the heatshield body to the barrel in a continuous spaced relationship therefrom along an entire length of the heatshield body without damaging the barrel.

17. The method of claim 16, wherein the rear mounting arrangement includes a non-metal resilient clip having an inner surface provided with a first silicon pad structure engageable with the barrel, and an outer surface provided with nibs that are snap fit into walls defining rear mounting holes on the rear end of the heatshield body.

18. The method of claim 16, wherein the front mounting arrangement includes a pair of non-metal spacer blocks provided with projections that are snap fit into walls defining front mounting holes at the front end of the heatshield body, the spacer body being provided with a second silicon pad structure engageable with a lower portion of the barrel.

19. The method of claim 18, wherein the front mounting arrangement further includes a third silicon pad structure snap fit by means of a tab into a mounting hole formed in the upper wall of the heatshield body at the front end thereof, and engageable with an upper portion of the barrel.

20. The method of claim 19, wherein the front mounting arrangement also includes a pair of rail attachments positioned on external surfaces of the opposed sidewalls at the front end of the heatshield body, and a pair of fasteners enabling the clamping of the front mounting arrangement, each fastener being passed through one of the rail attachments, one of the sidewalls, the pair of the spacer blocks and the other of the opposed walls, and threaded into the other of the rail attachments.

21. The method of claim 16, wherein thermal insulating elements are provided in the clipping structure and the clamping structure for preventing heat transfer from the barrel to the heatshield body.

22. A firearm heatshield assembly comprising:

a heatshield body having a pair of opposed ends, the heatshield body being adapted to overlie a barrel of a firearm; and an insulating mounting arrangement frictionally attached to and located within the heatshield body, the insulating mounting arrangement being adapted to mount the heatshield body to the barrel of the firearm in a continuous spaced relationship therefrom, wherein one end of the heatshield body is provided with a first set of mounting holes located on opposed sidewalls of the heatshield body, and the other end of the heatshield body is provided with a second set of mounting holes located on the opposed sidewalls and on an upper end of the heatshield body, wherein the insulating mounting arrangement includes a resilient, arcuate clip having an inner surface provided with a first silicon pad structure, and an outer surface provided with nibs which are snap fit into walls defining the first set of mounting holes, and wherein lower portions of the clip are provided with wings which are snap fit into engagement with lower edges on the opposed sidewalls of the heatshield body.

23. A method of mounting a heatshield assembly to a metal barrel of a firearm, the method comprising the steps of:

a) providing a heatshield body having a rear end, a front end, an arcuate upper wall and a pair of opposed sidewalls depending from the upper wall;

b) providing a rear mounting arrangement which is snap fit within the rear end of the heatshield body;

c) providing a front mounting arrangement which is snap fit within the front end of the heatshield body;

d) snapping the rear mounting arrangement onto a rear portion of the barrel; and e) clamping the front mounting arrangement on a front portion of the barrel, wherein the front mounting arrangement and the rear mounting arrangement mount the heatshield body to the barrel in a continuous spaced relationship therefrom without damaging the barrel, and wherein the front mounting arrangement includes a pair of non-metal spacer blocks provided with projections that are snap fit into walls defining front mounting holes at the front end of the heatshield body, the spacer body being provided with a second silicon pad structure engageable with a lower portion of the barrel.

* * * * *